US005161582A

United States Patent [19]

Wakamatsu

[11] Patent Number: 5,161,582

[45] Date of Patent: Nov. 10, 1992

[54] ONE PICK WEFT INSERTING METHOD AND CONTROL SYSTEM FOR JET LOOM START-UP

[75] Inventor: Kensuke Wakamatsu, Matsutou, Japan

[73] Assignee: Tsudakoma Kogyo Kabushiki Kaisha, Kanazawa, Japan

[21] Appl. No.: 664,741

[22] Filed: Mar. 5, 1991

[30] Foreign Application Priority Data

Mar. 5, 1990 [JP] Japan ..... 2-54736

[51] Int. Cl.[5] ..... D03D 47/30

[52] U.S. Cl. ..... 139/116.2; 139/194

[58] Field of Search ..... 139/116.2, 194, 435.1

[56] References Cited

U.S. PATENT DOCUMENTS

| | | | |
|---|---|---|---|
| 3,299,912 | 1/1967 | Birmans et al. | 139/194 |
| 3,744,533 | 7/1973 | Yano et al. | 139/194 |
| 4,465,110 | 8/1984 | Dekker | 139/194 X |
| 4,601,314 | 7/1986 | Gunneman | 139/435.1 X |
| 4,620,570 | 11/1986 | Suzuki | 139/116.2 |
| 4,781,221 | 11/1988 | Onishi et al. . | |
| 4,989,645 | 2/1991 | Velechovsky | 139/116.2 |

FOREIGN PATENT DOCUMENTS

| | | |
|---|---|---|
| 279222 | 8/1988 | European Pat. Off. . |
| 306998 | 3/1989 | European Pat. Off. . |
| 344104 | 5/1989 | European Pat. Off. . |
| 54-55660 | 5/1979 | Japan . |
| 58-197350 | 11/1983 | Japan . |
| 60-185843 | 9/1985 | Japan . |
| 630672 | 6/1982 | Switzerland . |

*Primary Examiner*—Andrew M. Falik

*Attorney, Agent, or Firm*—Oblon, Spivak, McClelland, Maier & Neustadt

[57] ABSTRACT

A one pick weft inserting, a defective weft determination method and method and a one pick weft inserting control system in a jet loom are provided wherein, in restarting the operation of the jet loom, one pick of weft is inserted and the weft is held securely to permit a smooth start-up of the jet loom. A weft length measuring device and a weft inserting nozzle are operated by a one pick command section provided in the control system to ensure one pick weft inserting into a warp shed, and after completion of the weft inserting operation, the warp shed is closed by a shed closing control section provided in the control system to hold the one pick weft securely, thereby preventing breaking, etc. of the weft.

5 Claims, 4 Drawing Sheets

ONE PICK WEFT INSERTING METHOD AND CONTROL SYSTEM FOR JET LOOM START-UP

DISCUSSION OF THE BACKGROUND

The present invention relates to a one pick weft inserting method and a one pick weft inserting control system in a jet loom for maintaining one pick of inserted weft positively in a restartable state prior to start-up of the jet loom.

Sometimes, in the event a jet loom stops its operation due to defective weft inserting for example, one pick of weft is inserted into a warp shed in a stopped state of the loom prior to restarting of the operation of the loom, and thereafter the loom is started up.

Generally, when a defective weft is removed in a loom, the operation of which has been stopped due to defective weft inserting, for example, the position of a cloth fell changes by a distance corresponding to a woven in portion of the defective weft and this is unavoidable. Further, this positional change eventually causes a weaving bar because beating is performed at the time of reverse operation of the loom after removal of the defective weft. To prevent the formation of such weaving bar, a defective weft is removed and one pick of weft is inserted in advance.

Also, according to the above removal and one pick weft-insertion, the length of the inserted weft can be adjusted to a proper state, thus resulting in the fact that the first weft inserting step can be operated with certainty after start-up of the loom.

Such one pick weft inserting operation (hereinafter referred to simply as "one pick weft inserting") can be done manually. It is also known to perform this weft inserting operation automatically by controlling a main nozzle, a weft length measuring device disposed behind the main nozzle, and a sub nozzle disposed in front of the main nozzle. In this regard, reference is here made to, for example, Japanese Patent Laid-Open Nos. 55660/79, 197350/83 and 185843/85.

More particularly, while the operation of the loom is stopped, the main nozzle and the sub nozzle (both hereinafter be referred to as named a "weft inserting nozzle") are operated and one pick of weft is unwound from the weft length measuring device and inserted into a warp shed. Particularly, according to the technique disclosed in Japanese Patent Laid-Open No. 55660/79, one pick of inserted weft is sucked by a suction nozzle provided on the side opposite to the feed side and in this state a loom is started up.

In such conventional technique, one pick weft inserting itself is performed under a normal condition and a predetermined tension is applied to the inserted weft, so that when the loom assumes a state permitting the start-up occurs breaking, resulting in short pick. More particularly, after one pick weft inserting and until start-up of the loom it is necessary to continue the operation of the weft inserting nozzle and that of the suction nozzle and thereby continue to maintain the weft at a predetermined tension, so the exposure time to a fluid jet becomes too long and there occurs untwisting of the weft, thus resulting in the strength being deteriorated to an extreme degree.

SUMMARY OF THE INVENTION

The present invention has been accomplished in view of the above-mentioned problem of the prior art, and it is a principal object of the invention to provide a one pick weft inserting method and a one pick weft inserting control system in a jet loom capable of maintaining an inserted one pick weft positively in a state permitting the start-up of the loom without causing a short pick due to breaking when one pick weft inserting has been completed.

For achieving the above object, according to the gist of the method, when a jet loom is to be started up, a weft length measuring device and a weft inserting nozzle are operated for one pick weft inserting, and a warp shed is closed while the weft is pulled by a weft pulling device.

According to the gist of the control system disclosed, the control system comprises a one pick command section for operating a weft length measuring device, a weft inserting nozzle and a weft pulling device in accordance with a command signal to carry out a one pick weft inserting operation, and a shed closing control section for closing a warp shed in accordance with a completion signal provided from the one pick command section.

DETAILED DESCRIPTION OF THE PREFERRED EMBODIMENTS

Embodiments of the present invention will be described hereinunder with reference to the accompanying drawings.

Figure 2:
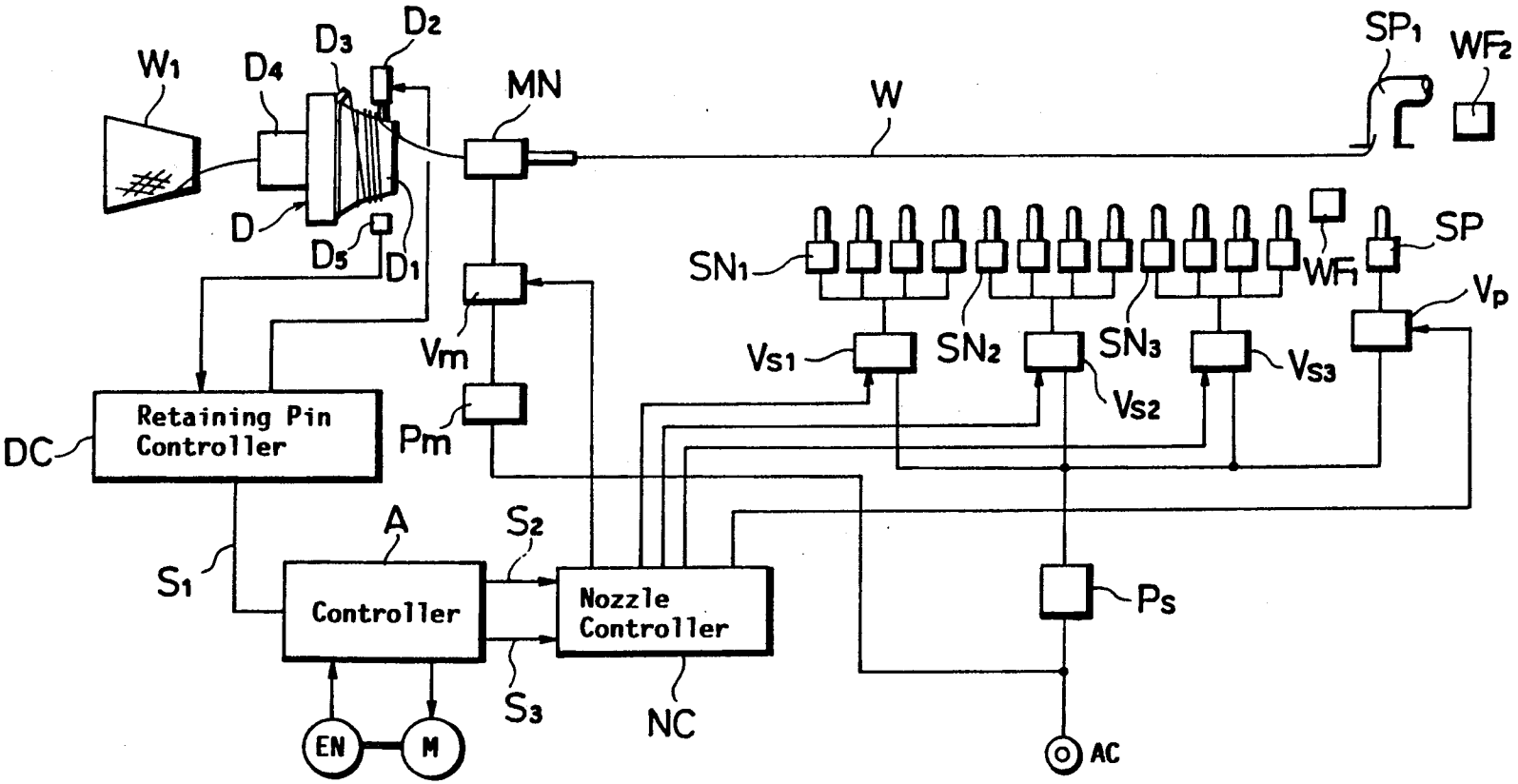
FIG. 2 is an entire explanatory view showing in what state the control system illustrated in FIG. 1 is used.

The loom used herein is assumed to be an air jet loom. As shown in FIG. 2, a weft W fed from a feeder W1 is measured for its length and is stored by a drum type weft length measuring device D, then is inserted into a warp shed (not shown) through a main nozzle MN.

The weft length measuring device D has a drum D1, a retaining pin D2 and a rotary yarn guide D3. The rotary yarn guide D3 is rotated by a motor D4, whereby the weft W can be wound and stored onto the drum D1. By a retaining pin controller DC in the weft length measuring device D the retaining pin D2 is moved to a unwinding position at a predetermined time to unwind the weft W from the drum D1 and then is moved back to the retaining position whereby the unwinding operation can be stopped. In the vicinity of the drum D1 there is provided an unwinding sensor D5 to count the number of windings of the weft W being unwound from the drum D1, whereby the length of the weft W unwound can be measured and controlled.

Along a traveling path of the weft W there are disposed a plurality of groups of sub nozzles SNi (i=1, 2, . . . ). The sub nozzles SNi operate successively group by group, whereby the weft W which is inserted by the main nozzle MN can be conveyed up to the side opposite to the weft inserting side.

On the side opposite to the weft W inserting side there are disposed a weft feeler WF1 for detecting a leading end of the weft W inserted, a stretch nozzle SP serving as a weft pulling device, and an auxiliary weft feeler WF2. The stretch nozzle S is provided in opposed relation to a bent pipe SP1 and air is jetted from the stretch nozzle SP, whereby the leading end of the weft W can be blown into the bent pipe SP1 and a predetermined tension can be applied to the weft W. The auxiliary weft feeler WF2 is disposed near the rear end of the bent pipe SP1 to detect the weft W. In the event of breaking of the inserted weft W, the feeler WF2 detects it.

The main nozzle MN is connected to an air source AC through an on-off valve Vm and a pressure regulating valve Pm. The sub nozzles SNi are connected to the air source AC through on-off valves Vsi (i=1, 2 . . . ) provided in corresponding relation to the sub nozzle groups and further through a common pressure regulating valve Ps. The stretch nozzle SP is connected to a downstream side of the pressure regulating valve Ps through an on-off valve Vp. The on-off valves Vm, Vsi and Vp are each independently controlled with respect to their opening and closing motions each independently by a nozzle controller NC.

Figure 1:
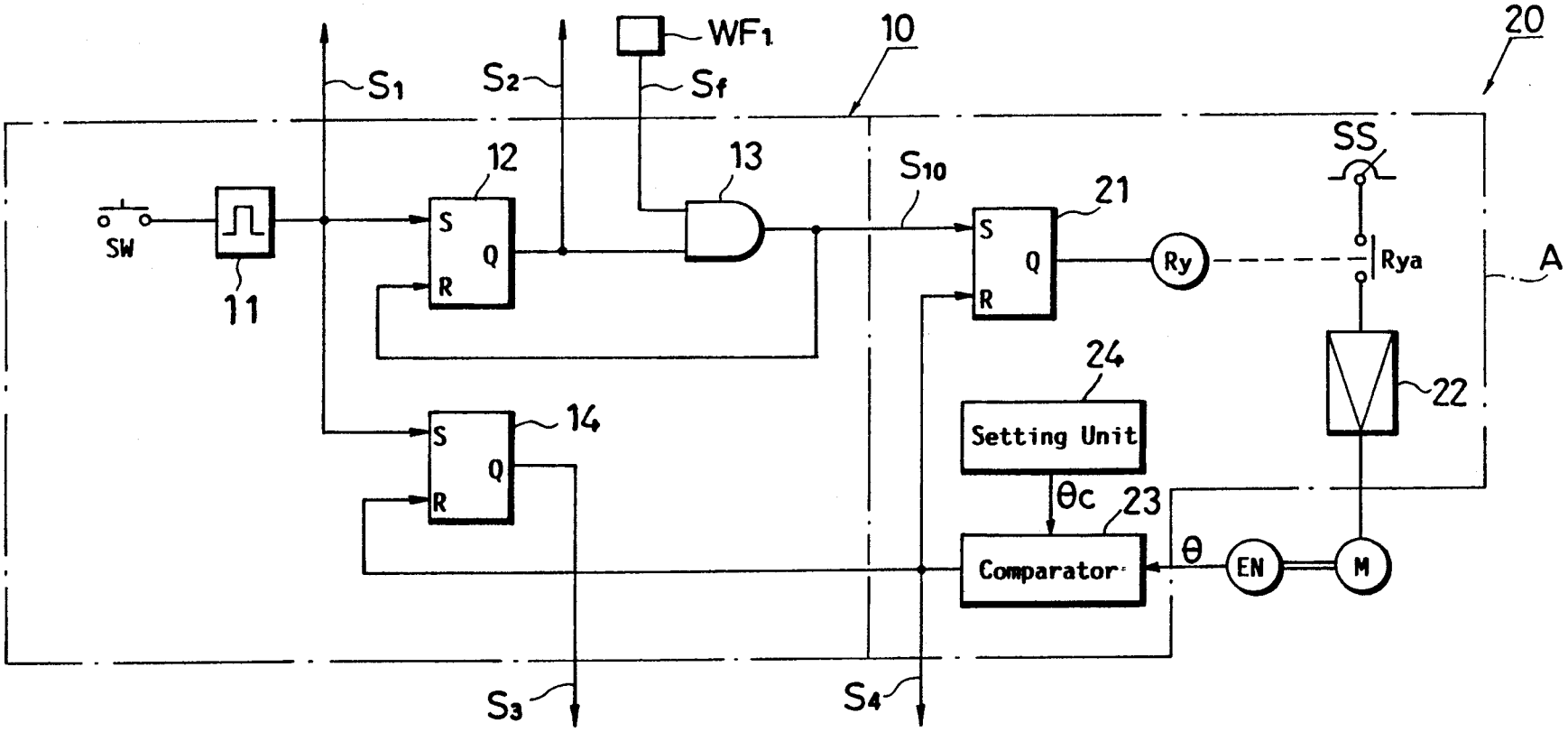
FIG. 1 is an entire system diagram showing a control system according to an embodiment of the present invention.

A one pick weft inserting control system (simply referred to as a "control system" hereinafter) A in the jet loom comprises a one pick command section 10 and a shed closing control section 20, as shown in FIG. 1.

The one pick command section 10 of the control system A comprises a command switch SW, a monomultivibrator 11, flip-flops 12, 14 and an AND gate 13.

The command switch SW is connected to set terminals S, S of the flip flops 12 and 14 through the monomultivibrator 11, and the output of the monomultivibrator 11 is drawn out to the exterior as a command signal S1.

An output terminal Q of the flip-flop 12 is not only connected to the AND gate 13 but is also branched to the exterior as an operation signal S2. An output signal Sf of the weft feeler WF1 is also inputted to the AND gate 13. The output of the AND gate 13 is not only fed as a completion signal S10 to the shed closing control section 20 but is also branched and connected to a reset terminal R of the flip-flop 12. On the other hand, another operation signal S3 is drawn out to the exterior from an output terminal Q of the flip-flop 14, while to a reset terminal R of the same flip-flop is fed a start preparation completion signal S4 from the shed closing control section 20.

When the warp shed is closed, the shed closing control section 20 inputs the completion signal S10 from the one pick command section 10 and outputs the start preparation completion signal S4 to both the one pick command section 10 and a loom control circuit (not shown). The completion signal S10 is fed to a set terminal S of flip-flop 21, while to an output terminal Q of the same flip-flop is connected a relay Ry. Further, the start preparation completion signal S4 is fed to a reset terminal R of the flip-flop 21.

In the shed closing control section 20 there is provided a control amplifier 22 having a speed setter SS, and a normally open contact Rya of the relay Ry is interposed between the control amplifier 22 and the speed setter SS. The output of the control amplifier 22 is connected to a main motor M. There is provided an encoder EN connected directly or indirectly to the main motor M to detect a rotational angle, as a loom mechanical angle $\theta$, of a loom shaft which is driven by the main motor. The output of the encoder EN in fed to a comparator 23 which is included in the shed closing control section 20. A setting unit 24 is attached to the comparator 23. The comparator 23 provides an output signal which is the start preparation completion signal S4.

The command signal Sl and the operation signals S2, S3 from the control system A are fed to the retaining pin controller DC and the nozzle controller NC, respectively, as shown in FIG. 2.

Now an example of how to operate the above control system will be described below in detail.

Figure 3:
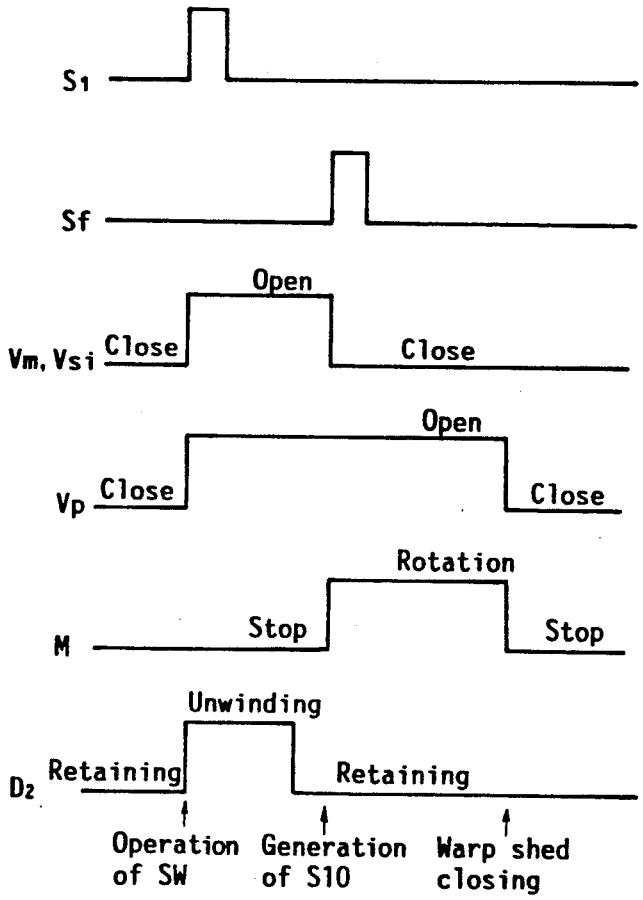
FIG. 3 is a view explanatory of the operation of the control system, etc. illustrated in FIG. 2.

Upon occcurrence of an improper (poor) insertion of weft, the loom is stopped automatically and then the loom is rotated in a reverse direction under the control of a manual or well-known automatic poor weft removing device and further stopped at a position where the warp has an opening, followed by removal of the poor weft. Then, when commands switch SW is turned on under the control of the manual or automatic poor weft removing device, a command signal S1 is produced through the monomultivibrator 11 (see FIG. 3). The command signal S1 is fed to the retaining pin controller DC, which in turn moves the retaining pin D2 from the retaining position to the unwinding position, so that the weft W can be unwound from the drum D1. On the other hand, with the command signal S1, the flip-flops 12 and 14 in the one pick command section 10 are set and operation signals S2, S3 are fed to the nozzle controller NC. In accordance with the operation signal S2 the nozzle controller NC opens the on-off valves Vm and Vsi to operate the main nozzle MN and the sub nozzle SNi, whereby the weft W is inserted into the warp shed (not shown). Further simultaneously with the opening of the on-off valves Vm and Vsi, or with an appropriate slight time lag, the nozzle controller NC opens the on-off valve Vp to operate the stretch nozzle SP in accordance with the operation signal S3.

When a predetermined length of the weft W is inserted in this way, an output signal is developed from the unwinding sensor D5 and it is detected by the retaining pin controller DC, which in turn moves the retaining pin D2 back to the retaining position to stop the unwinding operation for the weft W. At this time, the leading end of the weft W is blown into the bent pipe SP1 past the front of the weft feeler WF1, but does not reach the weft feeler WF2 because the weft length is measured exactly by the weft length measuring device D.

When the weft W reaches the weft feeler WF1, an output signal Sf is generated from the weft feeler WF1, whereby a completion signal S10 is developed as an output signal of the AND gate 13. With the completion signal S10, the flip-flop 12 is reset and the operation signal S2 is extinguished, so that the nozzle controller NC closes the on-off valves Vm and Vsi to stop the operation of the main nozzle MN and that of the sub nozzle SNi. At this time, the stretch nozzle SP continues to operate, so there is no fear of the weft W becoming loose.

On the other hand, with the completion signal S10, the flip-flop 21 in the shed closing control section 20 is set. As a result, the relay Ry operates and the main motor M is rotated at a low speed which is set by the speed setter SS, whereby the warp shed can be closed through the loom shaft (not shown) and further through a shedding motion interlocked with the loom shaft. This closed state of the warp can be detected by comparing in the comparator 23 the loom mechanical angle $\theta$ from the encoder EN with the value set in the setting unit 24, provided that in the setting unit 24 there is set a loom mechanical angle $\theta c$ corresponding to the shed closed state of the warp. Once the warp assumes the shed closed state, the weft W is held by the warp with a predetermined tension applied thereto by the stretch nozzle SP.

Upon detection of the warp shed closed state, the comparator 23 outputs the start preparation completion signal S4, whereby the flip-flops 21 and 14 are reset, the main motor M stops, and operation of the stretch nozzle SP can be stopped through the nozzle controller NC. Now, the loom may be started up by the loom control circuit on the condition that the start preparation completion signal S4 is present.

OTHER EMBODIMENTS

Figure 4:
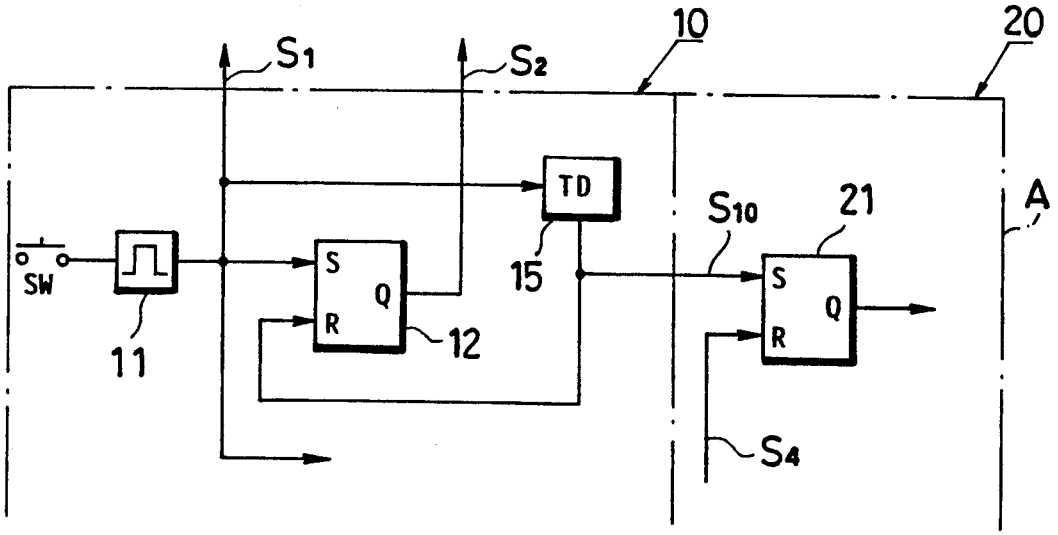
FIG. 4 is a system diagram of a principal portion of a control system according to another embodiment of the present invention.

The completion signal S10 from the one pick command section 10 may be outputted after the lapse of a predetermined time from the time when the command signal S1 was generated, in place of being outputted on the basis of the output signal Sf of the weft feeler WF1, as shown in FIG. 4. More specifically, a time delay element 15 which inputs the command signal S1 may be used in place of the AND gate 13. If the time corresponding to the weft traveling time required for the weft W to reach the side opposite to the weft inserting side is set as the delay time for the time delay element 15, there can be obtained just the same results as in the previous embodiment.

Figure 5:
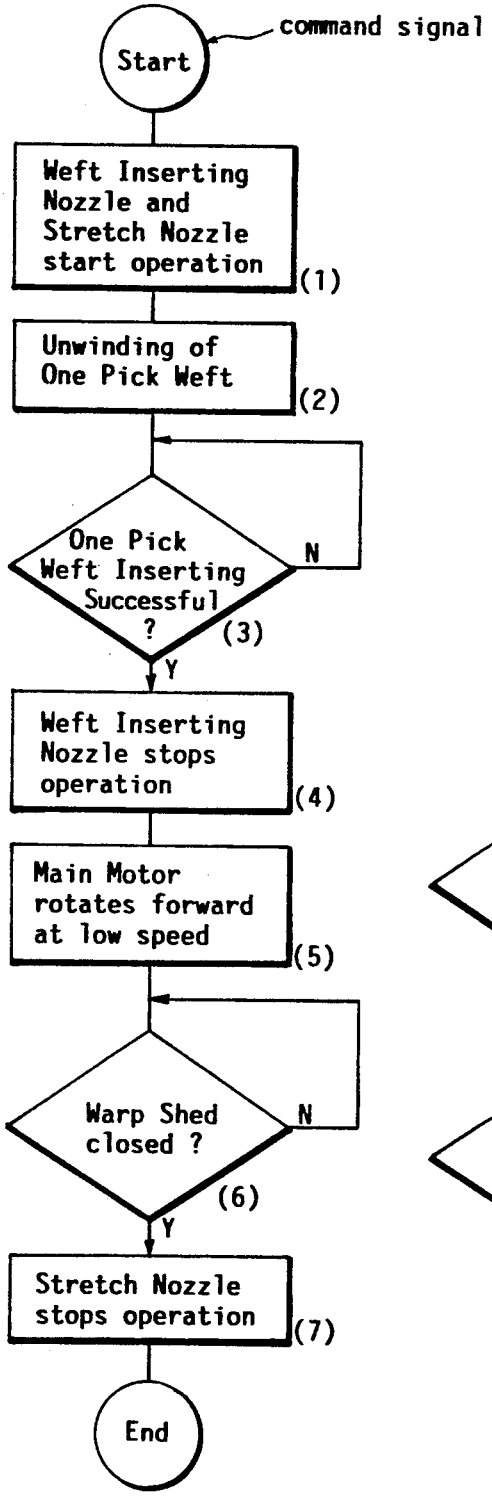
FIG. 5 is a flowchart of a control method according to the present invention, using a microcomputer.
Figure 6:
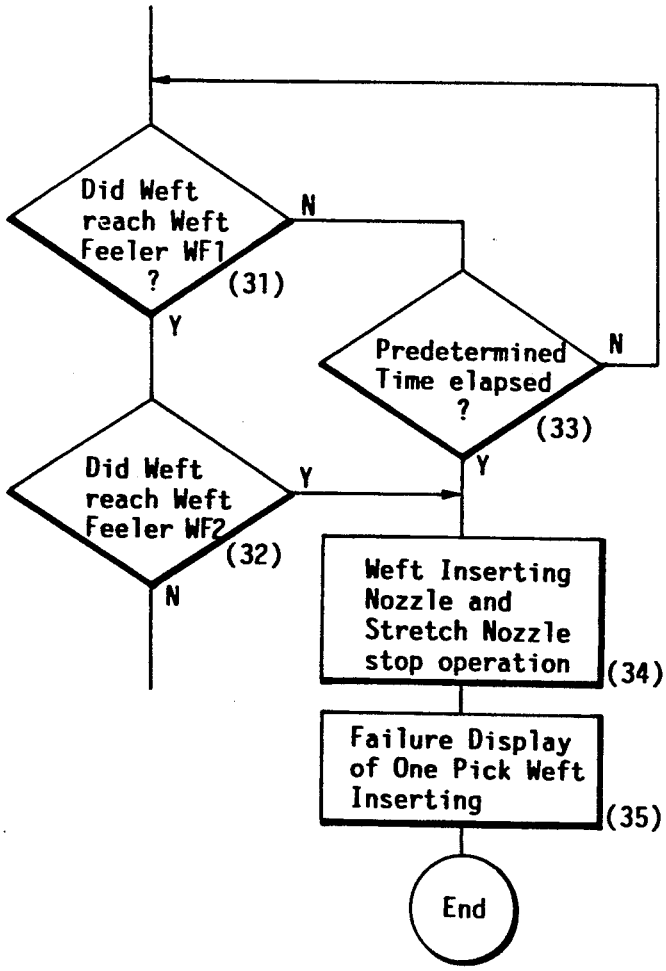
FIG. 6 is a detailed flowchart of a principal portion of FIG. 5.

The above embodiments can also be realized by a software using a microcomputer, provided the illustrations of FIGS. 5 and 6 correspond to the first embodiment.

According to a program, with the command signal S1, the weft inserting nozzle comprising the main nozzle MN and the sub nozzle SNi and the stretch nozzle SP starts, operating [step (1) in FIG. 5, the word "step" being omitted hereinafter]. Subsequently, one pick of weft W is unwound by controlling the retaining pin D2 of the weft length measuring device D (2), so that the weft W is inserted into a warp shed, and the program waits for the completion and results of the operation (3).

The details of step (3) in FIG. 5 are as illustrated in FIG. 6. In FIG. 6, the program confirms that the weft W has reached the weft feeler WF1 within a predetermined time (31)(33) and not reached the weft feeler WF2 (32), and concludes that the one pick weft inserting has been done successfully. On the other hand, in the case where the weft W has not reached the weft feeler WF1 within the predetermined time (31)(33), or when it has reached the weft feeler WF2 (32), it is determined that the one pick weft inserting has been unsuccessful. In this case, the operation of the weft inserting nozzle, etc. is stopped (34) and this state is displayed (35). Now, the program is over.

When one pick weft inserting has been successful (3), the operation of the weft inserting nozzle is stopped (4) and the main motor is driven at low speed (5), waiting for warp shed closing (6). Once the warp shed is closed and the weft W is held by the warp (6), operation of the stretch nozzle SP is stopped (7). Now, the program is over.

From a comparison between FIGS. 5 and 1 it is apparent that steps (1) to (4) in the former figure correspond to the one pick command section 10 in the latter figure and that steps (5) and (6) in the former figure correspond to the shed closing control section 20 in the latter figure.

The operation stop timing of the stretch nozzle SP is not so strict. Once the weft W is held by the warp, the possibility of damage of the weft is reduced under the pulling force of the stretch nozzle, so the operation of the same nozzle is stopped at an appropriate time, or it may be kept operating until start-up of the loom. In the event of breaking of the weft during the warp shed closing operation and when this state has been detected by the weft feeler WF2, the operation of the stretch nozzle SP is stopped and the warp may be returned to its open shed state. The stretch nozzle SP is not limited to such a combined form with the bent pipe SP1 as illustrated in FIG. 1. It may be of a type wherein a mechanical pulling force is applied to the weft W using a suitable movable brush or holding roller.

The present invention is also applicable to a water jet loom, and in this case it is to necessary to use the sub nozzle SNi.

According to the control method of the present invention, as set forth hereinabove, one pick weft inserting is performed and the warp shed is closed while the weft is pulled by the weft pulling device, whereby the weft can be maintained stably under a predetermined tension permitting restart-up of the loom by the warp during the long time after the one pick weft inserting and until start-up of the loom. Consequently, it is possible to effectively prevent breaking of the weft during that period.

In the control system of the present invention, the above method can be carried out easily by combining the one pick command section and the shed closing control section together.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A one pick weft inserting method in a jet loom which operates during stoppage of normal loom operation, which process comprises, in re-starting the operation of the jet loom, moving a warp shed to an open position thereof at which time loom operation is stopped, unwinding one pick of weft using a weft length measuring means;

inserting the one pick weft into a warp shed by operating a weft inserting nozzle;

detecting the inserted state of said one pick weft into the warp shed by a weft feeler and restarting a motor for operating the loom; and closing the warp shed to hold the weft while maintaining the weft under tension.

2. A one pick weft inserting method according to claim 1, wherein closing the warp shed comprises starting closing of the warp shed by a detected signal provided from said weft feeler.

3. A one pick weft inserting method according to claim 1, wherein closing of the warp shed comprises starting closing of the warp shed after the lapse of a predetermined time from when a command signal for the one pick weft inserting operation is generated.

4. A one pick weft inserting control system in a jet loom, comprising:

a one pick command section for operating a weft length measuring means, a weft inserting nozzle and a weft pulling means which operate in accordance with a command signal to perform a one pick weft inserting operation, and a warp shed closing control section for closing a warp shed on a weft which is being tensioned by the pulling means, wherein said one pick command section includes an AND gate for outputting a weft inserting completion signal on the basis of an output signal provided from a weft feeler.

5. A one pick weft inserting control system in a jet loom, comprising:

a one pick command section for operating a weft length measuring means, a weft inserting nozzle and a weft pulling means which operate in accordance with a command signal to perform a one pick weft inserting operation, and a warp shed closing control section for closing a warp shed on a weft which is being tensioned by the pulling means, wherein said one pick command section includes a time delay element for outputting a weft inserting completion signal after the lapse of a predetermined time from when a command signal is generated.

* * * * *